US010989461B2

(12) United States Patent
Dherde et al.

(10) Patent No.: US 10,989,461 B2
(45) Date of Patent: Apr. 27, 2021

(54) STRUCTURAL FORMATIONS INCORPORATED WITHIN A VACUUM INSULATED STRUCTURE

(71) Applicant: WHIRLPOOL CORPORATION, Benton Harbor, MI (US)

(72) Inventors: Eric J. Dherde, St. Joseph, MI (US); Alberto R. Gomes, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/309,752

(22) PCT Filed: Oct. 4, 2016

(86) PCT No.: PCT/US2016/055304
§ 371 (c)(1),
(2) Date: Dec. 13, 2018

(87) PCT Pub. No.: WO2018/067123
PCT Pub. Date: Apr. 12, 2018

(65) Prior Publication Data
US 2019/0137166 A1 May 9, 2019

(51) Int. Cl.
*F25D 23/06* (2006.01)

(52) U.S. Cl.
CPC ..... *F25D 23/063* (2013.01); *F25D 23/062* (2013.01); *F25D 23/066* (2013.01); *F25D 2201/14* (2013.01)

(58) Field of Classification Search
CPC .... F25D 23/063; F25D 23/062; F25D 23/066; F25D 2201/14
(Continued)

(56) References Cited

U.S. PATENT DOCUMENTS 225,629 A * 3/1880 Moseley
1,269,197 A * 6/1918 Mendenhall ..... F25D 23/062 220/592.26
(Continued)

FOREIGN PATENT DOCUMENTS

DE 102012223542 6/2014
EP 2447637 5/2012
(Continued)

*Primary Examiner* — Daniel J Troy
*Assistant Examiner* — Timothy M Ayres
(74) *Attorney, Agent, or Firm* — Price Heneveld LLP

(57) ABSTRACT

An appliance includes an outer wrapper and an inner liner that are connected to define a structural cabinet with an insulating cavity defined between the outer wrapper and the inner liner. An insulating material is disposed within the insulating cavity, wherein an at least partial vacuum is defined within the insulating cavity. The at least partial vacuum defines a pressure differential between the exterior of the structural cabinet and the insulating cavity, the pressure differential defining an inward compressive force. Wrapper structural reinforcements are disposed proximate the outer wrapper. Liner structural reinforcements are disposed proximate the inner liner, wherein each of the wrapper and liner structural reinforcements extend into the insulating cavity and are free of engagement with one another. The wrapper and liner structural reinforcements are positioned to resist the inward compressive force.

4 Claims, 6 Drawing Sheets

(58) Field of Classification Search
USPC ..... 312/404, 406–407.1
See application file for complete search history.

(56) References Cited

U.S. PATENT DOCUMENTS 1,518,668 A * 12/1924 Mitchell ..... F25D 23/062 220/592.02
1,898,977 A 2/1933 Comstock
1,987,798 A * 1/1935 Ruppricht ..... F16L 59/07 261/112.2
2,057,746 A * 10/1936 Schweller ..... F25D 23/062 220/592.11
2,246,578 A * 6/1941 De Salardi ..... B21B 1/08 428/593
2,745,173 A 5/1956 Janos
2,878,553 A * 3/1959 Hirsch ..... B21D 13/04 428/603
3,124,427 A * 3/1964 Chomes ..... E04B 1/644 428/603
3,194,622 A * 7/1965 Harter ..... F25D 23/061 220/592.14
3,206,902 A * 9/1965 Bertolini ..... B62D 33/048 52/582.1
3,273,976 A * 9/1966 Wogerbauer ..... B21D 13/04 428/603
3,332,170 A * 7/1967 Bangs ..... B61D 17/18 49/400
3,446,881 A * 5/1969 Poole ..... F25D 23/064 156/78
3,472,570 A * 10/1969 Moran ..... F25D 3/11 264/45.5
3,794,396 A * 2/1974 Vick ..... F25D 23/064 220/592.1
4,080,021 A * 3/1978 Pringle ..... F25D 23/066 312/406.2
4,113,549 A * 9/1978 Brimm ..... C23F 1/02 216/100
4,162,571 A * 7/1979 Horvay ..... F25D 21/04 264/46.5
4,190,305 A * 2/1980 Knight ..... E04H 5/10 220/592.1
4,740,042 A * 4/1988 Stich ..... F25D 23/04 108/901
4,837,388 A * 6/1989 Kugelmann ..... B21D 13/02 428/69
5,252,408 A 10/1993 Bridges et al.
5,310,073 A * 5/1994 Johannsson ..... A22B 7/008 220/254.3
5,529,645 A * 6/1996 Oswalt ..... B22D 25/02 148/549
5,618,633 A * 4/1997 Swanson ..... B22C 9/04 428/593
5,692,347 A * 12/1997 Hulek ..... E04C 2/322 428/595
6,001,449 A 12/1999 Hunter et al.
6,149,053 A * 11/2000 Chatterton ..... B65D 1/26 220/608
6,328,364 B1 * 12/2001 Darbishire ..... B60P 1/003 296/26.09
6,481,175 B2 * 11/2002 Potter ..... E04B 1/26 52/481.1
8,056,172 B2 * 11/2011 Schneider ..... A47L 15/4209 8/159
8,500,225 B2 * 8/2013 Kim ..... F25D 23/064 312/406
8,857,931 B2 * 10/2014 Jung ..... F25D 21/04 312/406.1
8,899,068 B2 * 12/2014 Jung ..... F25D 23/062 62/440
8,944,541 B2 * 2/2015 Allard ..... F25D 23/062 312/406
9,429,039 B2 * 8/2016 Finlayson ..... F01D 21/045
9,657,489 B2 * 5/2017 Harper ..... E04H 7/00
10,156,038 B2 * 12/2018 Bohm ..... D06F 39/12
2007/0001563 A1 * 1/2007 Park ..... B29C 44/1238 312/406
2007/0241645 A1 * 10/2007 Trulaske, Sr. ..... A47F 3/001 312/116
2008/0110126 A1 * 5/2008 Howchin ..... E04C 3/07 52/630
2008/0284302 A1 11/2008 Olson et al.
2010/0095622 A1 4/2010 Niemoller
2010/0127608 A1 * 5/2010 Kitamura ..... F25D 11/003 312/406.1
2013/0029082 A1 * 1/2013 Park ..... E04B 1/803 428/69
2013/0214664 A1 * 8/2013 Yoon ..... F16L 59/065 312/405
2013/0257257 A1 * 10/2013 Cur ..... F25D 23/065 312/406.1
2014/0346942 A1 * 11/2014 Kim ..... F25D 23/067 312/404
2015/0192347 A1 * 7/2015 Cho ..... F25D 21/04 62/272
2019/0128592 A1 * 5/2019 Westlake ..... B29D 99/001
2019/0285336 A1 * 9/2019 Naik ..... F16L 59/065

FOREIGN PATENT DOCUMENTS

| | | |
|---|---|---|
| EP | 2447638 | 5/2012 |
| JP | 07113492 | 5/1995 |
| RU | 2061925 | 6/1966 |
| WO | 9920964 | 4/1999 |

* cited by examiner

STRUCTURAL FORMATIONS INCORPORATED WITHIN A VACUUM INSULATED STRUCTURE

FIELD OF THE DEVICE

The device is in the field of vacuum insulated structures, and more specifically, a vacuum insulated structure incorporating structural geometries for avoiding vacuum bow resulting from the expression of gas during formation of the vacuum insulated structure.

SUMMARY

In at least one aspect, an appliance includes an outer wrapper and an inner liner that are connected to define a structural cabinet with an insulating cavity defined between the outer wrapper and the inner liner. An insulating material is disposed within the insulating cavity, wherein an at least partial vacuum is defined within the insulating cavity. The at least partial vacuum defines a pressure differential between the exterior of the structural cabinet and the insulating cavity. The pressure differential defines an inward compressive force. Wrapper structural reinforcements are disposed proximate the outer wrapper. Liner structural reinforcements are disposed proximate the inner liner, wherein each of the wrapper and liner structural reinforcements extend into the insulating cavity and are free of engagement with one another. The wrapper and liner structural reinforcements are positioned to resist the inward compressive force.

In at least another aspect, an insulating structure for an appliance includes first and second members that are attached to one another to define an insulating cavity therebetween. An insulating material is disposed within the insulating cavity. First structural reinforcements are disposed proximate the first member. Second structural reinforcements are disposed proximate the second member, wherein the first and second structural reinforcements are free of engagement with one another such that the insulating material extends continuously throughout the insulating cavity.

In at least another aspect, a method of forming a structural cabinet for an appliance includes disposing a plurality of wrapper structural reinforcements proximate an outer wrapper, disposing a plurality of liner structural reinforcements proximate an inner liner, attaching the outer wrapper to the inner liner to define an insulating cavity therebetween with the wrapper and liner structural reinforcements extending from the outer wrapper and inner liner, respectively, into the insulating cavity. The wrapper and liner structural reinforcements are free of contact with one another and are spaced apart from one another by a cavity space. An insulating material is disposed within the insulating cavity and fills the cavity space. Gas is expressed from the insulating cavity to define an at least partial vacuum within the insulating cavity, wherein the at least partial vacuum generates an inward compressive force exerted against the inner liner and the outer wrapper toward the insulating cavity. The insulating cavity is sealed, wherein the wrapper and liner structural reinforcements are positioned to oppose the inward compressive force and maintain the outer wrapper and the inner liner at a substantially consistent distance to maintain the volume of the cavity space between the wrapper and liner structural reinforcements.

These and other features, advantages, and objects of the present device will be further understood and appreciated by those skilled in the art upon studying the following specification, claims, and appended drawings.

DETAILED DESCRIPTION OF EMBODIMENTS

Figure 1:
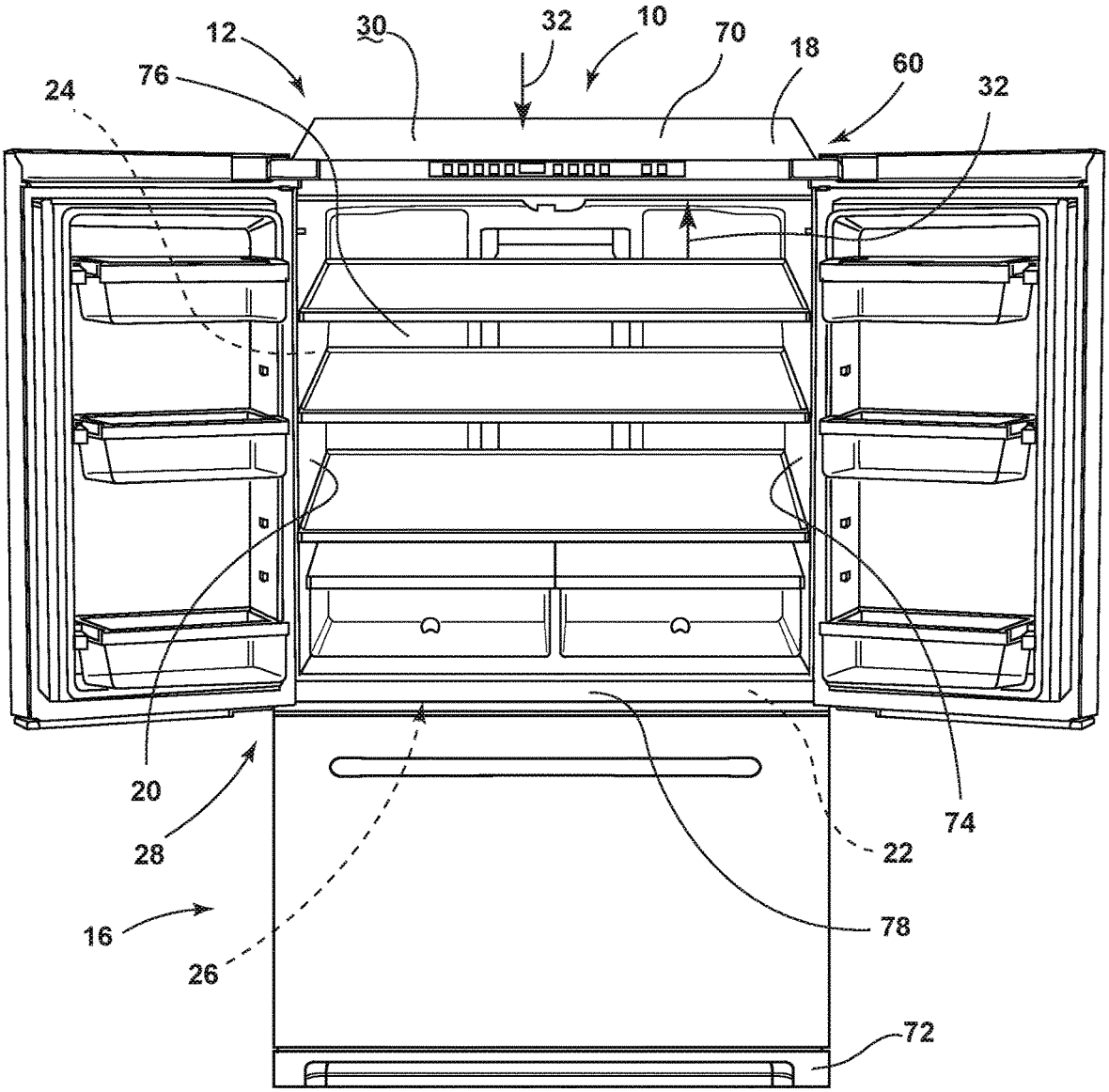
FIG. 1 is a front perspective view of an appliance incorporating aspects of the structural geometries proximate the inner liner and outer wrapper of the structural cabinet.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-8, reference numeral 10 generally refers to an insulating structure incorporated within an appliance 16. It is contemplated that the insulating structure 10 can be in the form of a vacuum insulated structural cabinet 12 or a vacuum insulating panel 14 that can be used as an insulation member for the appliance 16. According to the various embodiments, the appliance 16 can include an outer wrapper 18 and an inner liner 20 that are connected to define the structural cabinet 12 with an insulating cavity 22 defined between the outer wrapper 18 and the inner liner 20. An insulating material 24 is disposed within the insulating cavity 22. An at least partial vacuum 26 is defined within the insulating cavity 22, where the at least partial vacuum 26 defines a pressure differential 28 between the exterior 30 of the structural cabinet 12 and the insulating cavity 22. This pressure differential 28 serves to define an inward compressive force 32 that is exerted upon both of the outer wrapper 18 and the inner liner 20 and tends to bias the outer wrapper 18 and the inner liner 20 toward the insulating cavity 22 of the structural cabinet 12. Wrapper structural reinforcements 34 are disposed proximate the outer wrapper 18 and liner structural reinforcements 36 are disposed proximate the inner liner 20. It is contemplated that each of the wrapper and liner structural reinforcements 34, 36 are configured to extend into the insulating cavity 22. Additionally, the liner and wrapper structural reinforcements 36, 34 are free of engagement with one another, such that the insulating material 24 extends continuously through the insulating cavity 22 and extends between and separates the inner liner 20 and outer wrapper 18, as well as the wrapper and liner structural reinforcements 34, 36 from one another. It is further contemplated that the wrapper and liner structural reinforcements 34, 36 are shaped and positioned to resist the inward compressive force 32 generated by the pressure differential 28 of the at least partial vacuum 26 within the insulating cavity 22.

Referring again to FIGS. 1-8, the wrapper and liner structural reinforcements 34,36 include structural geometries 50 that are positioned proximate the outer wrapper 18 and inner liner 20, respectively. The wrapper and liner structural reinforcements 34, 36 may be in the form of corrugations within the structural cabinet 12 that resist bending, warping, bowing, or other deflection, along at least one axis 52. As discussed above, an inward compressive force 32 is exerted upon both the outer wrapper 18 and the inner liner 20 due to the pressure differential 28 between the exterior 30 of the structural cabinet 12 and the at least partial vacuum 26 within the insulating cavity 22. The corrugations, ridges, or other similar structural geometries 50 of the outer wrapper 18 and inner liner 20 serve as structural reinforcements that add rigidity to the components of the structural cabinet 12 to resist this inward compressive force 32. It is contemplated that the wrapper and liner structural reinforcements 34, 36 can be positioned to define distinct reinforcing sections 54 within the structural cabinet 12. Each of these distinct reinforcing sections 54 includes structural geometries 50 that are aligned along respective axes, where each distinct reinforcing section 54 resists deflection along each respective axis 52 defined within that particular distinct reinforcing section 54 of structural geometries 50.

Figure 3:
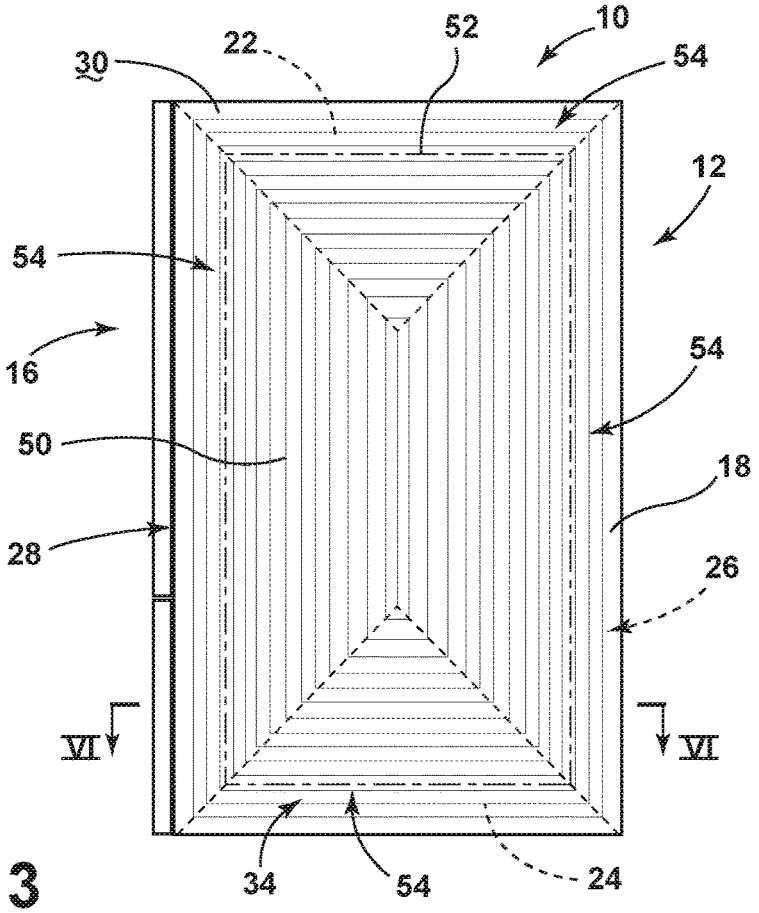
FIG. 3 is a side elevational view of the appliance of FIG. 2.
Figure 4:
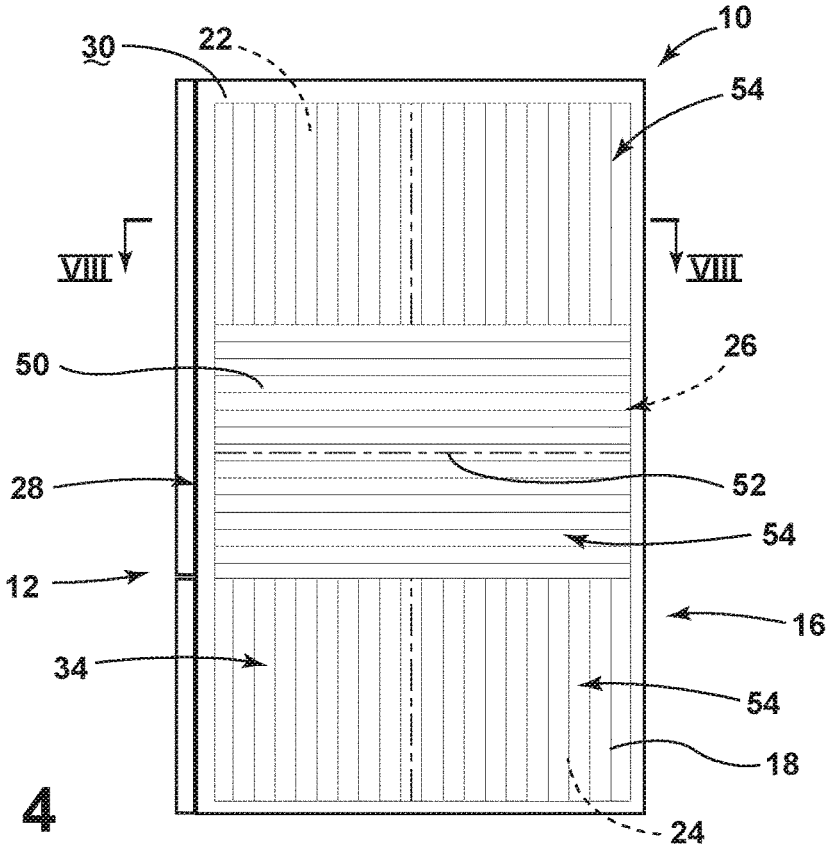
FIG. 4 is a side elevational view of an appliance incorporating an aspect of the structural geometries incorporated within the inner liner and outer wrapper of the appliance.

By way of example, and not limitation, FIGS. 3 and 4 show exemplary configurations of wrapper structural reinforcements 34 that are defined within the outer wrapper 18. These wrapper structural reinforcements 34 are oriented vertically and horizontally to allow for the resistance of deflection as a result of the inward compressive force 32 in at least two directions. It is contemplated that the wrapper and liner structural reinforcements 34, 36 can be positioned within the distinct reinforcing sections 54 along a plurality of respective axes 52 to resist deflection in a plurality of distinct axial directions. In this manner, the inner liner 20 and outer wrapper 18 of the structural cabinet 12 can be adapted to substantially resist deflection in various directions during and after formation of the at least partial vacuum 26 within the insulating cavity 22.

Referring again to FIGS. 2-4, it is contemplated that the wrapper structural reinforcements 34 and the liner structural reinforcements 36 can be defined within the outer wrapper 18 and the inner liner 20, respectively. In this manner, the wrapper and liner structural reinforcements 34, 36 serve to define visible relief patterns within the outer wrapper 18 and inner liner 20 of the structural cabinet 12. It is contemplated that the outer wrapper 18 can be a metallic member that includes the plurality of integral ridges that define the wrapper structural reinforcements 34. As discussed above, the integral ridges can be in the form of corrugations that resist deflection that may be caused by the inward compressive force 32 generated through the at least partial vacuum 26 within an insulating cavity 22. As discussed above, the plurality of integral ridges within the outer wrapper 18 can be positioned to define distinct reinforcing sections 54 within the outer wrapper 18. Each distinct reinforcing section 54 can define a distinct ridge orientation, such as vertical, lateral, diagonal, arcuate, irregular, or other similar orientation.

Figure 10:
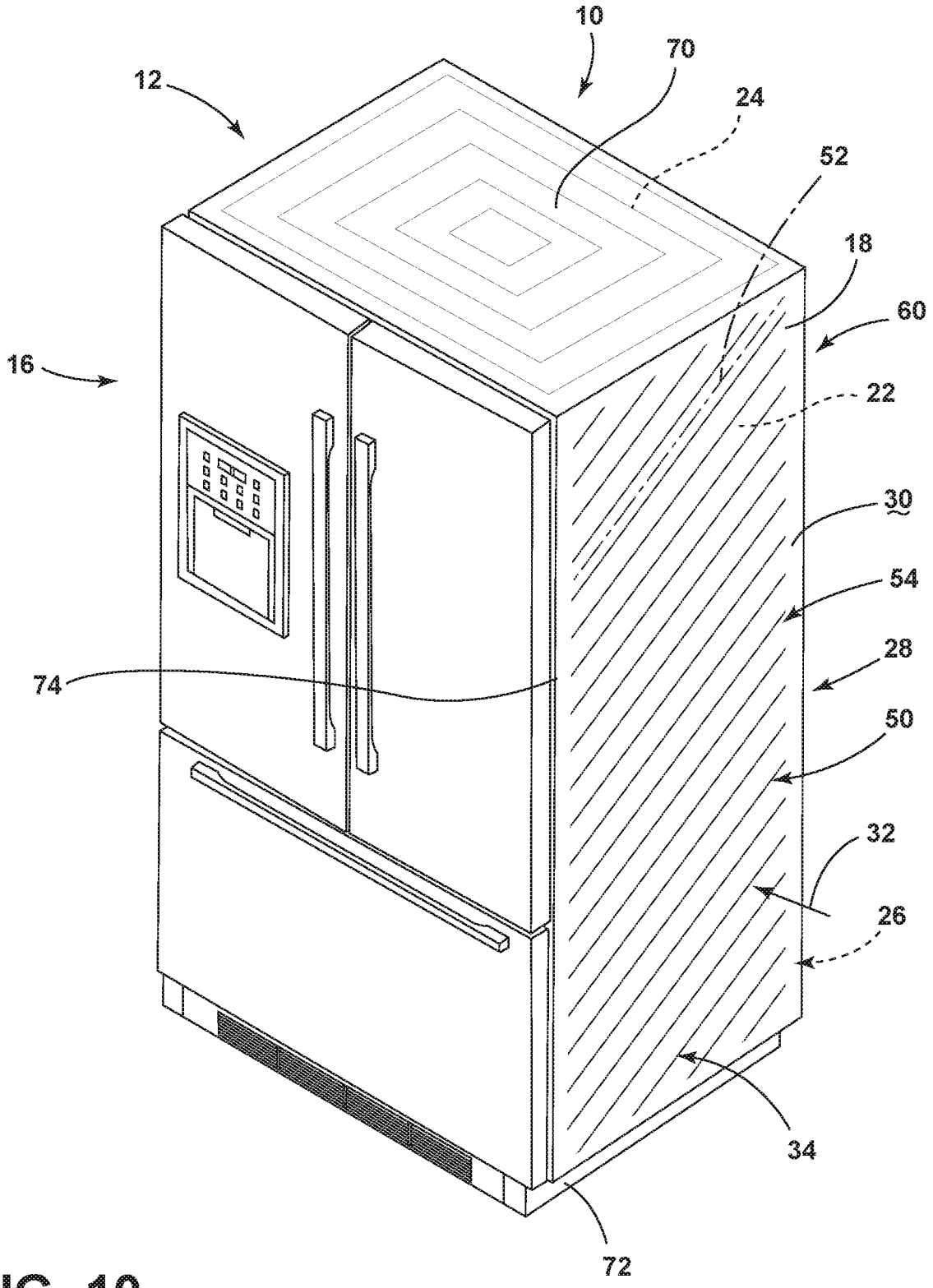
FIG. 10 is a perspective view of an appliance incorporating an aspect of the structural geometries positioned at an oblique angle and incorporated within the outer wrapper of a structural cabinet for an appliance.

Referring now to FIGS. 3, 4 and 10, the various distinct reinforcing sections 54 can include a first wrapper section and a second wrapper section. The integral structural geometries 50 of the first wrapper section can be oriented to be substantially perpendicular to the integral structural geometries 50 of the second wrapper section. It is further contemplated that the various distinct reinforcing sections 54, which can include the various wrapper sections and liner sections can be oriented to be perpendicular with respect to one another or can be disposed at other varying angles and configurations with respect to the other wrapper and liner sections defined within the structural cabinet 12.

It is contemplated that the structural geometries 50 of the various distinct sections can include ridges, scallops, corrugations, undulations, folds, bends, relief patterns, combinations thereof and other similar structural geometries 50. These structural geometries 50 can be formed through molding, rolling, stamping, bending, folding and other similar shaping processes.

Figure 2:
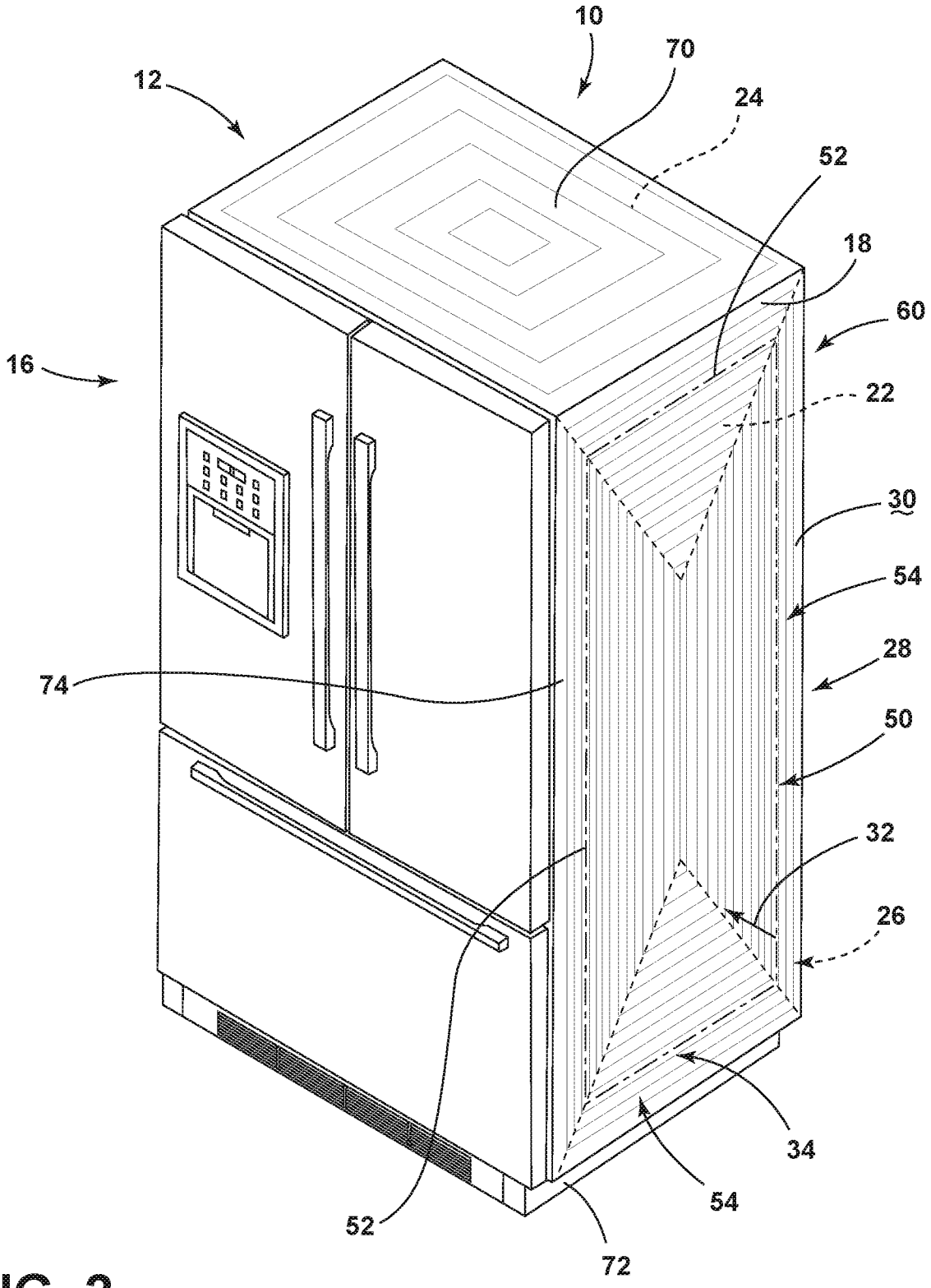
FIG. 2 is a perspective view of an appliance incorporating an aspect of the structural geometries incorporated within the inner liner and outer wrapper of a structural cabinet for an appliance.

While the various structural geometries 50 are defined within FIGS. 2-4 to be within sidewalls 74 of the structural cabinet 12, it is contemplated that the wrapper and liner structural reinforcements 34, 36 can be defined within each of the inner and outer walls of the structural cabinet 12. These structural walls 60 can include, but are not limited to, the top wall 70, bottom wall 72, sidewalls 74, back wall 76, interior walls, "dog house" walls, interior mullions 78, and other various structural walls 60 of the structural cabinet 12.

Figure 5:
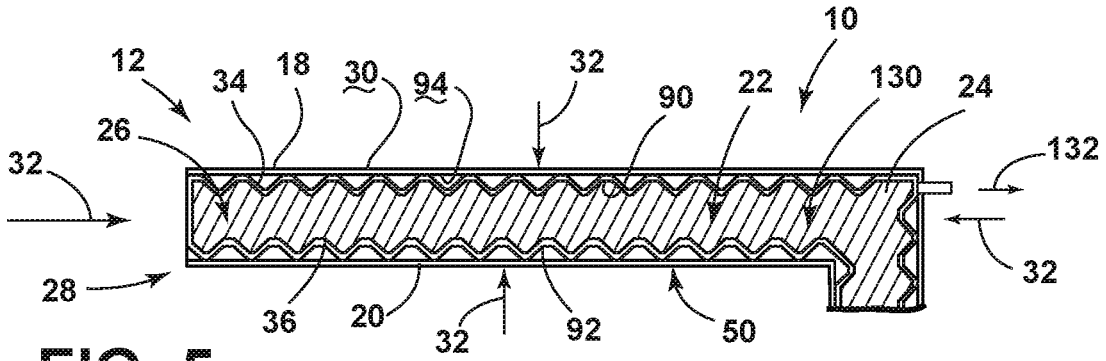
FIG. 5 is a cross-sectional view of an appliance incorporating an aspect of the structural geometries within reinforcing panels disposed within the insulating cavity of the structural cabinet.
Figure 6:
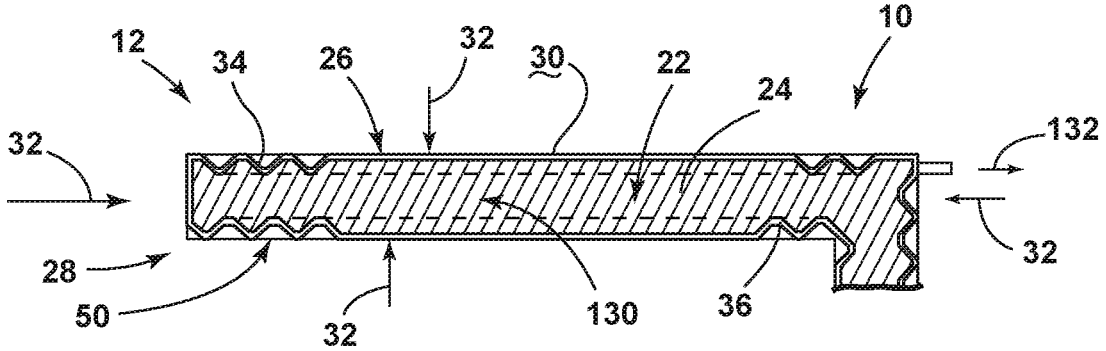
FIG. 6 is a cross-sectional view of the structural cabinet of FIG. 3 taken along line VI-VI.

Referring now to FIG. 5, it is contemplated that the wrapper and liner structural reinforcements 34, 36 can be defined within a wrapper reinforcing panel 90 and a liner reinforcing panel 92, respectively. The wrapper and liner reinforcing panels 90, 92 can be positioned proximate the outer wrapper 18 and the inner liner 20 and within the insulating cavity 22. In this manner, the wrapper and liner reinforcing panels 90, 92 may be placed next to or can be attached to interior surfaces 94 of the outer wrapper 18 and inner liner 20. In such an embodiment, the visible exterior 30 of the outer wrapper 18 and inner liner 20 can be smooth and flat, while the insulating cavity 22 can be reinforced through the use of the wrapper and liner reinforcing panels 90, 92 that contain the wrapper and liner structural reinforcements 34, 36. In this manner, the wrapper and liner reinforcing panels 90, 92 serve to prevent inward deflection of portions of the structural cabinet 12 as a result of the inward compressive force 32.

Figure 7:
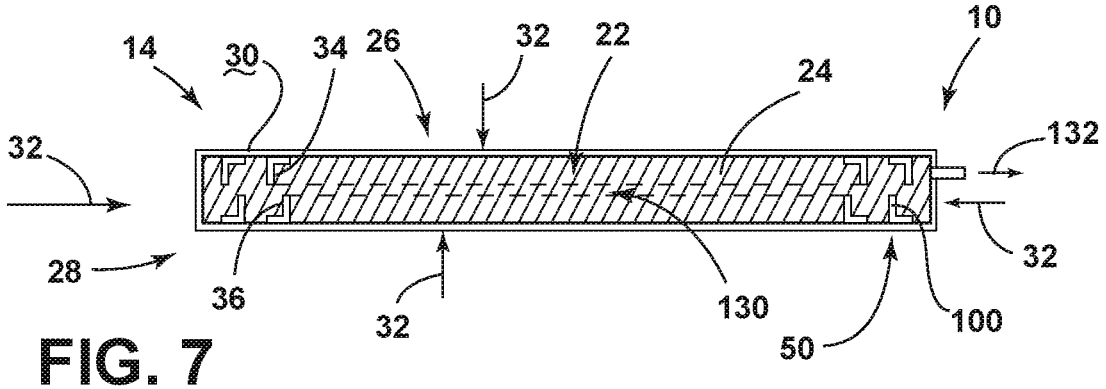
FIG. 7 is a cross-sectional view of a portion of a structural cabinet incorporating an aspect of the structural geometries incorporated within the inner liner and outer wrapper of the structural cabinet.
Figure 8:
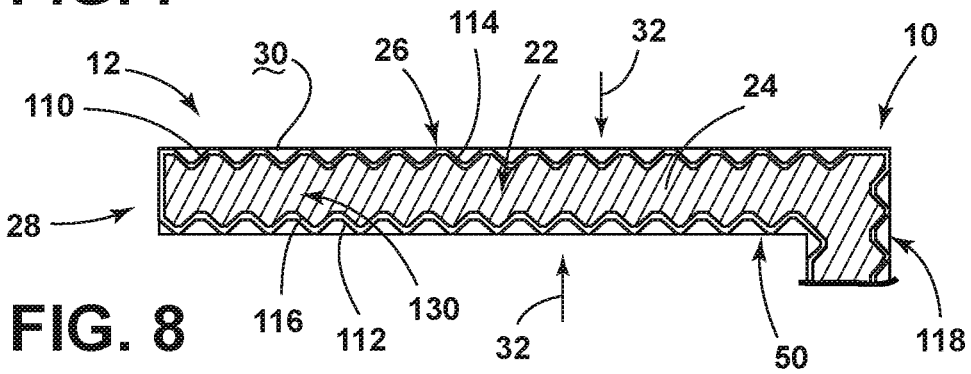
FIG. 8 is a cross-sectional view of the structural cabinet of FIG. 4 taken along line VIII-VIII.
Figure 9:
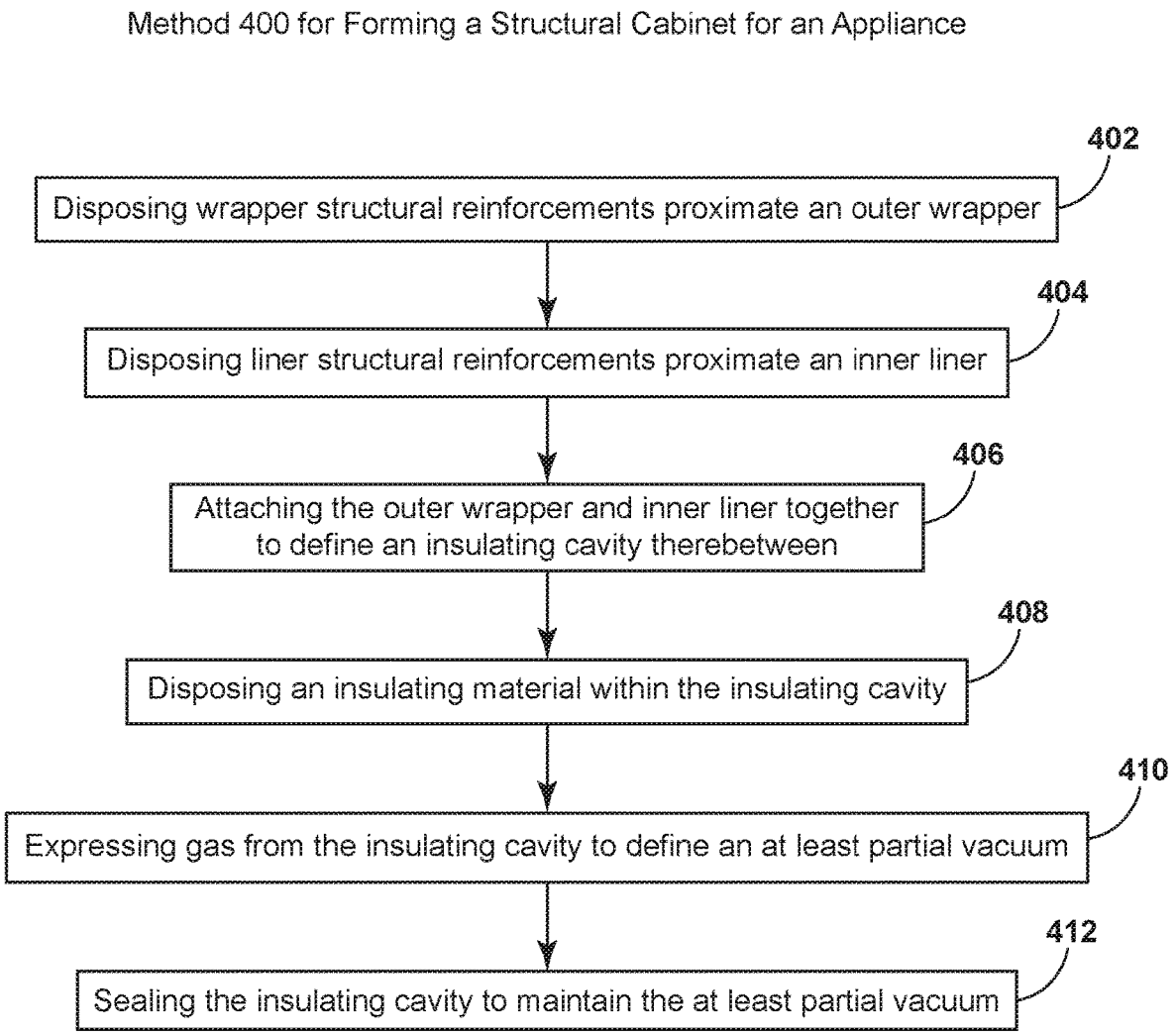
FIG. 9 is a linear flow diagram illustrating an aspect of a method for forming a structural cabinet for an appliance.

Referring now to FIG. 7, it is contemplated that the wrapper and liner structural reinforcements 34, 36 can be defined by structural members 100 that are attached to the interior surfaces 94 of the outer wrapper 18 and inner liner 20. According to various embodiments, the wrapper and liner structural reinforcements 34, 36 can be a plurality of steel members, such as steel angles that are positioned within the insulated cavity and attached to the inner liner 20 and outer wrapper 18 to resist inward deflection that may be caused by the inward compressive force 32 generated by the pressure differential 28. In such an embodiment, it is contemplated that the wrapper and liner structural reinforcements 34, 36 can be thickened portions of the inner liner 20 and outer wrapper 18, attached reinforcing members, and other similar applied structural members 100 that can be disposed within the insulating cavity 22 of the structural cabinet 12.

Referring again to FIGS. 2-4, 6 and 8, it is contemplated that the wrapper and liner structural reinforcements 34, 36 can be defined within the outer wrapper 18 and inner liner 20 themselves. In such an embodiment, both the outer wrapper 18 and the inner liner 20 can visibly reveal the configuration of the various wrapper and liner structural reinforcements 34, 36 defined therein. These wrapper and liner structural reinforcements 34 36 can be used as a decorative feature as well as for reinforcing the structural cabinet 12 to resist the inward compressive force 32 generated by the at least partial vacuum 26 in the insulating cavity 22.

Referring again to FIGS. 1-8, it is contemplated that the inner liner 20 and outer wrapper 18 can be made of various materials that can be shaped, bent or otherwise formed to include the various wrapper and liner structural reinforcements 34, 36 for the structural cabinet 12. These materials for the outer wrapper 18 and inner liner 20 can include, but are not limited to, metals, plastics, polymers, metal alloys, combinations thereof, and other similar substantially rigid materials that can be used for vacuum insulated structures within appliances 16. Typically, the inner liner 20 and outer wrapper 18 will be made of a metallic material with the wrapper and liner structural reinforcements 34, 36 defined within the material of the outer wrapper 18 and inner liner 20, respectively.

According to various embodiments, it is contemplated that the various distinct reinforcing sections 54 of wrapper and liner structural reinforcements 34, 36 can at least partially overlap to create sections of the wrapper and liner structural reinforcements 34, 36 that can resist bending, bowing, and other deflection along more than one axis 52. These overlapping sections of corrugations can form more complex geometries within the outer wrapper 18 and inner liner 20 that can serve to prevent deflection along at least two and potentially three or more axes. Accordingly, by incorporating the structural geometries 50, the outer wrapper 18 and inner liner 20 can be maintained at a substantially consistent spacing between one another to maintain the insulating cavity 22 at a consistent thickness throughout the structural cabinet 12 of the appliance 16.

Referring again to FIGS. 1-8, an insulating structure 10 for an appliance 16 can include first and second members 110, 112 that are attached to one another to define an insulating cavity 22 therebetween. The insulating material 24 is disposed within the insulating cavity 22 between the first and second members 110, 112. First structural reinforcements 114 can be disposed proximate the first member 110 and second structural reinforcements 116 can be disposed proximate the second member 112. It is contemplated that the first and second structural reinforcements 114, 116 are free of engagement with one another such that the insulating material 24 extends continuously through the insulating cavity 22. Stated another way, the first and second structural reinforcements 114, 116, which can correspond to the wrapper and liner structural reinforcements 34, 36 in a structural cabinet 12 setting, are continuously spaced apart from one another. By being spaced apart, the first and second structural reinforcements 114, 116 do not interrupt or separate portions of the insulating material 24 within the insulating cavity 22.

According to the various embodiments, it is contemplated that the thickness of the first and second structural reinforcements 114, 116 can each be within a range of from approximately 1 millimeter to approximately 10 millimeters. It is contemplated that the first and second structural reinforcements 114, 116 can be sized to provide for sufficient structural rigidity of the first and second members 112 and also a minimal thickness of the insulating cavity 22 that provides sufficient insulating functions for the insulating structure 10 of the appliance 16.

Referring again to FIGS. 2-8, the first and second structural reinforcements 114, 116 can be defined by integral undulations 118 that are formed within the first and second members 110, 112. It is contemplated that the first and second structural reinforcements 114, 116 are adapted to extend within the insulating cavity 22 and extend toward one another such that the insulating material 24 is shaped to conform to the shape of the integral undulations 118 defined within the first and second members 110, 112.

According to various embodiments, as exemplified in FIGS. 2-4, where the wrapper and liner structural reinforcements 34, 36 are integrally formed within the outer wrapper 18 and inner liner 20, respectively, and where the first and second structural reinforcements 114, 116 are integrally formed within the first and second members 110, 112 of the insulating structure 10, the various structural reinforcements are visible on the exterior 30 of the insulating structure 10. These various visible patterns generate a structural relief pattern that is visible on the exterior 30 of the insulating structure 10 and/or the structural cabinet 12. More complex structural relief patterns can be formed where the various ridge sections overlap to form more complex geometries within the inner liner 20, outer wrapper 18, and first and second members 110, 112.

Referring again to FIG. 5, it is contemplated that the first and second structural reinforcements 114, 116 can be defined within various reinforcing panels that are disposed proximate the first and second members 110, 112 and within the insulating cavity 22. As discussed above, the use of the wrapper and liner reinforcing panels 90, 92 disposed within the insulating cavity 22 serves to allow the exterior 30 of the insulating structure 10 to maintain a smooth and continuous visible appearance.

Referring again to FIGS. 2-4, 6-8 and 10, the integral undulations 118 defined within the first and second members 110, 112 can be oriented to define a plurality of distinct reinforcing or undulating sections within each of the first and second members 110, 112. It is contemplated that each undulating section includes a dedicated axis 52 along which the integral undulations 118 are oriented. The various undulating sections of the first and second members 110, 112 can have dedicated axis 52 that are set at various angles within the first and second members 110, 112. In this manner, each of the first and second members 110, 112 is adapted to resist the inward compressive force 32 along at least two axis 52. Additionally, these undulating sections can overlap, such that each dedicated section may define multiple axes 52 along which the inward compressive force 32 can be resisted through the corrugated configuration of the first and second members 110, 112 of the insulating structure 10.

As discussed above, the insulating cavity 22 defines an at least partial vacuum 26 that serves to generate an inward compressive force 32 exerted against the first and second members 110, 112 and toward the insulating cavity 22. This inward compressive force 32 is generated through a pressure differential 28 between a normal atmospheric pressure present around the exterior 30 of the insulating structure 10 and the at least partial vacuum 26 present within the insulating cavity 22. This pressure differential 28 generates the inward compressive force 32 exerted upon the first and second members 110, 112 of the insulating structure 10, similar to that of the inward compressive force 32 exerted against the outer wrapper 18 and inner liner 20 of the structural cabinet 12.

Referring now to FIGS. 1-9, having described various aspects of insulating structures 10 that incorporate the structural reinforcements, a method 400 is disclosed for forming a structural cabinet 12 for an appliance 16. According to the method 400, a plurality of wrapper structural reinforcements 34 is disposed proximate an outer wrapper 18 (step 402). A plurality of liner structural reinforcements 36 is also disposed proximate an inner liner 20 (step 404). As discussed above, the wrapper and liner structural reinforcements 34, 36 can be integrally formed within the outer wrapper 18 and inner liner 20, respectively. These wrapper and liner structural reinforcements 34, 36 can also be defined within structural reinforcing panels that are disposed within an insulating cavity 22 of the structural cabinet 12. According to the method 400, the outer wrapper 18 is attached to the inner liner 20 to define an insulating cavity 22 therebetween (step 406). The wrapper and liner structural reinforcements 34, 36 are adapted to extend from the outer wrapper 18 and inner liner 20, respectively, and into the insulating cavity 22. It is contemplated that the wrapper and liner structural reinforcements 34, 36 are free of contact with one another and are spaced apart from one another by a cavity space 130.

Referring again to FIGS. 1-9, once the structural cavity is formed through attachment of the inner liner 20 and the outer wrapper 18, an insulating material 24 is disposed within the insulating cavity 22 (step 408). It is contemplated that the insulating material 24 fills or substantially fills the cavity space 130. In this manner, the insulating material 24 forms a continuous insulating layer that extends between the wrapper and liner structural reinforcements 34, 36. Because the wrapper and liner structural reinforcements 34, 36 do not touch one another, these features do not interrupt, separate, or otherwise segregate portions of the insulating material 24. This configuration can serve to limit thermal transfer between interior portions of the inner liner 20 and the outer wrapper 18. Once the insulating material 24 is disposed within the cavity space 130, gas 132 can be expressed and/or expelled from the insulating cavity 22 to define an at least partial vacuum 26 within the insulating cavity 22 (step 410). As discussed above, the at least partial vacuum 26 generates the inward compressive force 32 that is exerted against the inner liner 20 and the outer wrapper 18 and is exerted toward the insulating cavity 22. This inward compressive force 32 serves to bias the inner liner 20 and outer wrapper 18 toward the insulating cavity 22 such that the inner liner 20 and outer wrapper 18 tends to bow inward as a result of the inward compressive force 32 which could result in thinning of the structural walls 60 of the insulating structure 10, and a decrease in thermal performance. The use of the wrapper and liner structural reinforcements 34, 36 serves to oppose this inward compressive force 32 and opposes the tendency of the inner liner 20 and outer wrapper 18 to bow. As a result, the inner liner 20 and outer wrapper 18 are maintained a substantially consistent distance from one another to maintain a substantially consistent undulating thickness of the insulating cavity 22.

After expressing and/or expelling gas 132 from the insulating cavity 22, the insulating cavity 22 is sealed (step 412). The wrapper and liner structural reinforcements 34, 36 are positioned to oppose the inward compressive force 32 and maintain the outer wrapper 18 and the inner liner 20 at the substantially consistent distance. This substantially consistent distance serves to maintain the volume of the cavity space 130 between the wrapper and liner structural reinforcements 34, 36 to be substantially the same as that volume when the outer wrapper 18 and inner liner 20 were attached such as at step 406 of the method 400.

According to the various embodiments, the method 400 for forming the structural cabinet 12 can also be used for forming an insulating structure 10, such as an insulating panel 14, a structural cabinet 12, or other similar insulating member. These various insulating members can be used in various appliances 16 that can include, but are not limited to, refrigerators, freezers, coolers, ovens, dishwashers, laundry appliances, water heaters, and other similar appliances and fixtures within household and commercial settings.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method of forming a structural cabinet for an appliance, the method comprising steps of:

stamping a plurality of wrapper structural reinforcements within a plurality of wrapper panels of an outer wrapper, the wrapper structural reinforcements being obliquely angled with respect to each wrapper panel of the plurality of wrapper panels, and wherein the wrapper structural reinforcements are a consistent, consecutive, and repeating pattern of at least three wrapper structural reinforcements that are visible on each side of the plurality of wrapper panels, and wherein the wrapper structural reinforcements extend continuously and a substantial majority of a distance between a front edge and a back edge of each wrapper panel of the plurality of wrapper panels, and wherein the wrapper structural reinforcements have a relief thickness in a range of from approximately 1 millimeter to approximately 10 millimeters;

stamping a plurality of liner structural reinforcements within an inner liner;

attaching the outer wrapper to the inner liner to define an insulating cavity therebetween with the wrapper and liner structural reinforcements extending from the outer wrapper and the inner liner, respectively, into the insulating cavity, the wrapper and liner structural reinforcements being free of contact with one another and spaced apart from one another by a cavity space;

disposing an insulating material within the insulating cavity, the insulating material filling the cavity space, wherein the insulating cavity is free of additional structural reinforcements that interrupt portions of the insulating material;

expressing gas from the insulating cavity to define an at least partial vacuum within the insulating cavity;

wherein the at least partial vacuum generates an inward compressive force exerted against the inner liner and the outer wrapper toward the insulating cavity; and sealing the insulating cavity, wherein the wrapper and liner structural reinforcements are positioned to oppose the inward compressive force and maintain the outer wrapper and the inner liner at a substantially consistent distance to maintain a volume of the cavity space between the wrapper and liner structural reinforcements.

2. The method of claim 1, wherein the wrapper and liner structural reinforcements are integral undulations that define a plurality of distinct reinforcing sections, each distinct reinforcing section having a dedicated axis.

3. The method of claim 1, wherein the relief thickness of the wrapper structural reinforcements is approximately 1millimeter.

4. The method of claim 1, wherein the plurality of wrapper structural reinforcements within each wrapper panel of the plurality of wrapper panels are defined within at least two distinct reinforcing portions of each wrapper panel, and wherein the plurality of wrapper structural reinforcements within each distinct portion of the at least two distinct reinforcing portions are parallel and aligned along a single linear axis.

* * * * *